US006262755B1

(12) United States Patent
Skubic et al.

(10) Patent No.: US 6,262,755 B1
(45) Date of Patent: Jul. 17, 2001

(54) MULTICOLOR THERMAL PRINTING APPARATUS

(75) Inventors: Robert L Skubic, Chanhassen; Ronald L. Sattler, Bloomington; Timothy J Flitsch, Savage, all of MN (US)

(73) Assignee: Datacard Corporation, Minneapolis, MN (US)

( * ) Notice: Subject to any disclaimer, the term of this patent is extended or adjusted under 35 U.S.C. 154(b) by 0 days.

(21) Appl. No.: 08/996,652

(22) Filed: Dec. 23, 1997

(51) Int. Cl.[7] ..... B41J 2/325
(52) U.S. Cl. ..... 347/173; 347/213
(58) Field of Search ..... 347/219, 172, 347/173, 213, 217, 216; 400/120.02, 120.04, 120.01, 618, 235, 236, 236.1, 236.2, 248

(56) References Cited

U.S. PATENT DOCUMENTS

| | | | | |
|---|---|---|---|---|
| Re. 33,260 | * | 7/1990 | Stephenson | 400/120.04 |
| 4,179,210 | | 12/1979 | Bestenreiner et al. . | |
| 4,438,696 | | 3/1984 | George et al. . | |
| 4,495,507 | | 1/1985 | Moriguchi et al. . | |
| 4,594,597 | | 6/1986 | Lin et al. . | |
| 4,694,305 | | 9/1987 | Shiomii et al. . | |
| 4,703,346 | * | 10/1987 | Bierhoff | 400/120.02 |
| 4,707,706 | | 11/1987 | Nagano . | |
| 4,739,341 | * | 4/1988 | Matsuno et al. | 347/216 |
| 4,857,941 | | 8/1989 | Kaida . | |
| 4,863,297 | | 9/1989 | Fujii . | |
| 4,923,848 | * | 5/1990 | Akada et al. | 347/213 |
| 5,189,477 | | 2/1993 | Leys et al. . | |
| 5,196,864 | * | 3/1993 | Caine | 347/173 |
| 5,247,314 | * | 9/1993 | Stephenson | 347/173 |
| 5,281,038 | * | 1/1994 | Schofield et al. | 400/235 |
| 5,440,328 | | 8/1995 | Nardone et al. . | |
| 5,528,277 | | 6/1996 | Nardone et al. . | |
| 5,532,724 | * | 7/1996 | Inagaki et al. | 347/213 |
| 5,546,115 | | 8/1996 | Nardone et al. . | |
| 5,546,116 | | 8/1996 | Nardone et al. . | |
| 5,600,362 | | 2/1997 | Morgavi et al. . | |
| 5,610,649 | | 3/1997 | Kokubo . | |

FOREIGN PATENT DOCUMENTS 195 43 099 5/1997 (DE) .

OTHER PUBLICATIONS

Copy of International Search Report for PCT/US98/22951. 09/96, "An Introduction to Digital Color Printing",AGFA Education Publishing, pp 2–5.

* cited by examiner

*Primary Examiner*—Huan Tran
(74) *Attorney, Agent, or Firm*—Merchant & Gould P.C.

(57) ABSTRACT

An apparatus and method for multi-color printing on plastic cards, such as credit cards, identification cards, and the like. The printing apparatus includes a rotatably driven cylinder having a smooth, high friction outer surface, and a plurality of color print stations spaced circumferentially about the cylinder. A receptor web supply roll is mounted adjacent to the cylinder and supplies an uninterrupted length of a receptor web to the outer surface of the cylinder. The receptor web is frictionally engaged with the outer surface of the cylinder such that the web rotates therewith when the cylinder is rotated. A stepper motor and gearing assembly is connected to the cylinder for rotating the cylinder, and therefore the receptor web that is disposed on the outer surface thereof, to position the receptor web relative to the color print stations. The stepper motor and gearing assembly allow precise positioning of the cylinder and the receptor web relative to each print head, to ensure precise print registration.

12 Claims, 3 Drawing Sheets

MULTICOLOR THERMAL PRINTING APPARATUS

FIELD OF THE INVENTION

This invention relates to color printers, and more particularly to a multicolor thermal printer to perform color printing on a receptor web material that is then mated with a plastic card so that the color image on the receptor material can be transferred onto the card.

BACKGROUND OF THE INVENTION

In a traditional color printer for plastic cards, a ribbon having three different color segments is passed by a single print head and the card is moved back and forth into position relative to the print head to allow each color to be printed. A problem with this type of printer is the relatively low throughput caused by the numerous back and forth movements of the card. Further, the numerous back and forth movements results in a printing process that is not smooth. In addition, a printer of this type cannot print to the edge of the card.

U.S. Pat. No. 5,440,328 to Nardone et al discloses a compact color printer that utilizes three non-driven platen rollers arranged in an arc, with three color print heads disposed around the rollers to print onto a receptor media. Output drive rollers are used to pull the receptor media through the printer, with the printed receptor media being output through an output slot in the printer. The receptor media is output from the printer in its final form and is not applied to a card to transfer the printed image onto the card.

SUMMARY OF THE INVENTION

The present invention provides an apparatus and method for multi-color printing on plastic cards, such as credit cards, identification cards, and the like. The present invention provides a printing apparatus that is compact and able to perform precise single pass, multi-color printing onto a receptor web, with the web then being mated with a plastic card to permit transfer of the color image from the web onto the card. The present invention eliminates the numerous back and forth movements of the prior art, thereby increasing the throughput of the printer, as well as smoothing the printing operation. Further, by printing initially onto a receptor web and then transferring the image to the card, the entire image can be printed on the web, eliminating the problem of printing at the edge of the card.

A preferred embodiment of the printing apparatus in accordance with the principles of the present invention includes a rotatably driven cylinder having a smooth, high friction outer surface, and a plurality of color print stations spaced circumferentially about the cylinder. A receptor web supply roll is mounted adjacent to the cylinder and supplies an uninterrupted length of a receptor web to the outer surface of the cylinder. The receptor web is frictionally engaged with the outer surface of the cylinder such that the web rotates therewith when the cylinder is rotated. An incremental digital drive mechanism, such as a stepper motor and gearing assembly, is connected to the cylinder for rotating the cylinder, and therefore the receptor web disposed on the outer surface thereof, to position the receptor web relative to the color print stations. The incremental digital drive mechanism allows precise positioning of the cylinder and the receptor web relative to each print head, thereby ensuring precise registration between the receptor web and the print beads.

The invention further includes a method of multi-color printing on a card including providing a rotatably driven cylinder having an outer, high friction surface and a plurality of color print stations spaced circumferentially about the cylinder. An uninterrupted length of a receptor web is supplied to the outer surface of the cylinder and is in frictional engagement therewith such that the web moves with the cylinder. The cylinder is then rotated to position the receptor web relative to a first one of the color print stations, and the first color print station then prints onto the receptor web. The cylinder is repeatedly rotated to position the web relative to each color print station until the entire printed image is printed on the receptor web. The receptor web is then mated with the card to thereby transfer the printed image from the receptor web onto the card.

These and various other advantages and features of novelty which characterize the invention are pointed out with particularity in the claims annexed hereto and forming a part hereof. However, for a better understanding of the invention, its advantages and objects attained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
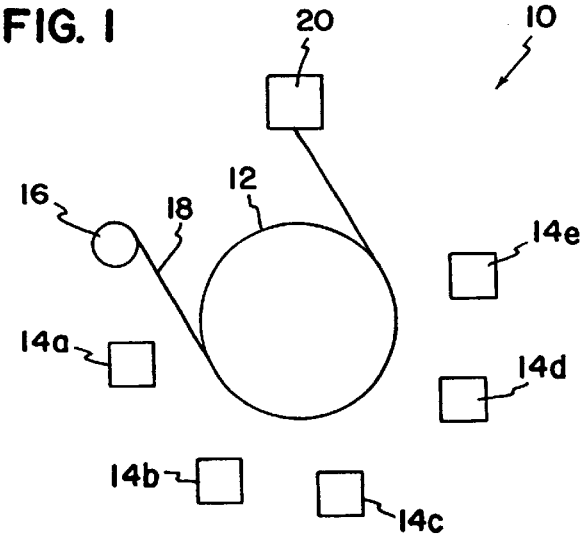
FIG. 1 is a diagrammatic view of the printing apparatus and a mating and image transfer station.

Referring now to the drawings, the printing apparatus in accordance with the principles of the present invention is generally referred to by the numeral 10. With reference to FIG. 1, the apparatus 10 includes a rotatably mounted cylinder 12, and a plurality of color print stations 14*a–e* disposed at spaced locations around the cylinder 12. The cylinder 12 includes an outer surface that is preferably formed by a silicon coated rubber material to provide a high friction gripping surface, as well as chemical resistance to the coloring used in the color print stations 14*a–e*. The silicon coated rubber material is preferably soft and compliant to assure compliance between the printhead, print ribbon, and the receptor web.

A receptor web supply roll 16 is rotatably mounted adjacent the cylinder 12 for supplying a receptor web 18 to the outer surface of the cylinder. The roll 16 is freely rotatable, i.e. not driven, with the web 18 extending from the roll 16 to the high friction outer surface of the cylinder 12, whereby the feeding of the web 18 from the roll 16 is caused by the rotation of the cylinder 12. The web 18 extends around, and is integral with, the majority of the outer surface of the cylinder, and finally separates from the outer surface past the last print station 14*e*, with the web then extending to a mating and image transfer station 20, where the receptor web 18 is mated with the plastic cards to thereby permit transfer of the printed image from the receptor web to the plastic cards.

The receptor web 18 is of conventional three-layer construction including a carrier layer, a topping layer, and an ink receptor layer. In use, the topping layer and the ink receptor layer are intended to be laminated onto the card, thereby transferring the image onto the card. Other receptor web materials could be used if desired, as long as the receptor web permits printing of the image thereon and permits subsequent transfer of the image to the card. The mating and image transfer station 20 is a conventional arrangement suitable for mating the receptor web with one of the cards, and for causing transfer of the image from the receptor web onto the card. For instance, a pair of conventional heated pressure rollers could be used, between which the receptor web and card pass to cause the topping layer and the ink receptor layer to be laminated onto the card, thereby transferring the image onto the card.

Since the outer surface of the cylinder 12 is highly frictional, the receptor web is gripped by the outer surface and moves integrally therewith as the cylinder is driven in rotation, with no slippage occurring between the web 18 and the outer surface. Thus feeding of the receptor web from the roll 16 is caused by the rotation of the cylinder, with the cylinder being used to position the receptor web relative to each print station 14*a–e* using a drive mechanism 130 explained in more detail below.

Figure 2:
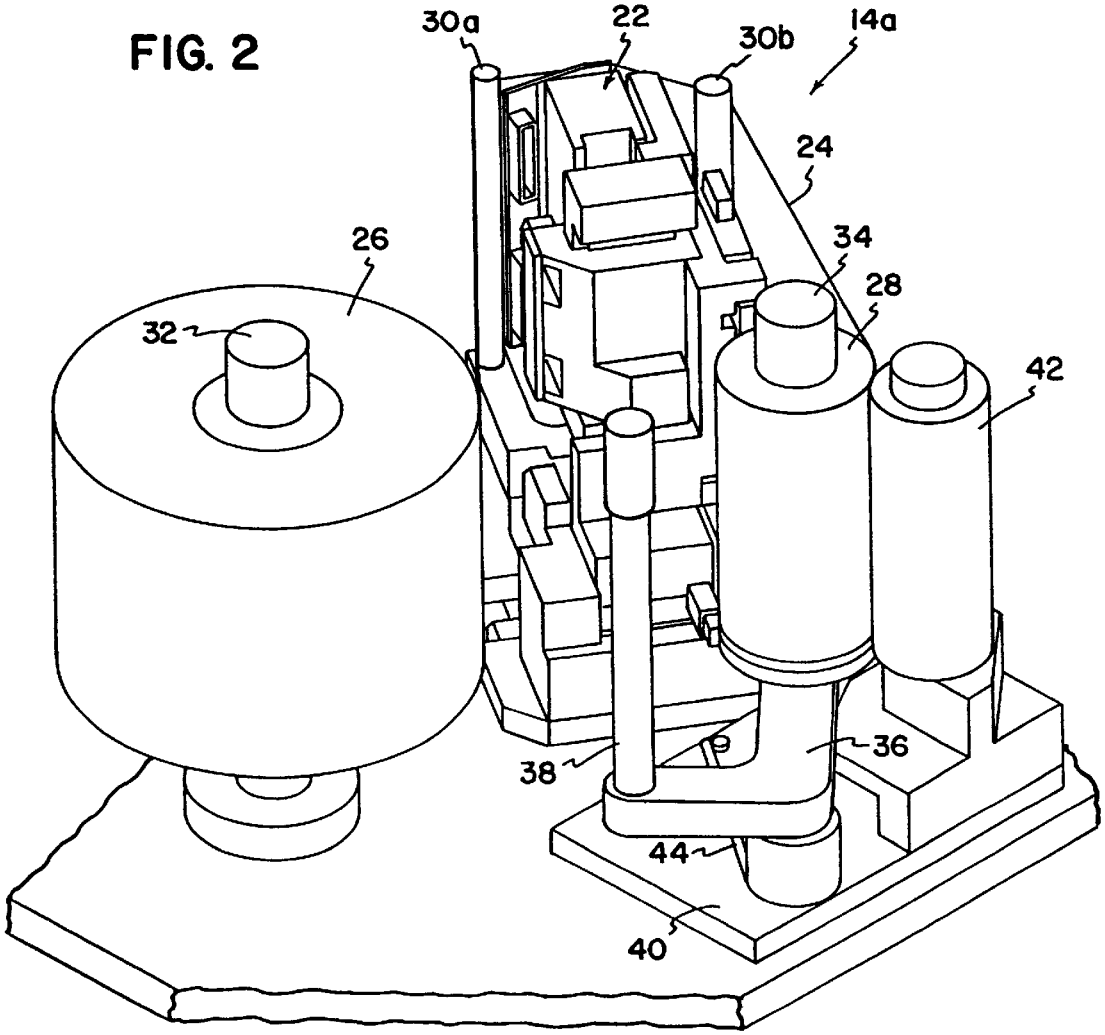
FIG. 2 is a detailed view of one of the print stations.

With reference to FIG. 2, the details of the print station 14*a* are illustrated, it being understood that each of the other print stations 14*b–e* are identical in construction to the print station 14*a*. The color print station 14*a* includes a print head 22, a color print-ribbon 24, a print-ribbon feed roll 26, a print-ribbon take-up roll 28, and a pair of print-ribbon guides 30*a–b*. The print head 22, shown diagrammatically in FIG. 2, is preferably a thermal print head, although other types of print heads can be used if desired.

The print-ribbon 24 is fed from the feed roll 26, around the guide 30*a*, past the print head 22, past the guide 30*b*, and onto the take-up roll 28. The print head 22 is mounted so as to be moveable in a radial direction relative to the cylinder 12 between a non-print position, at which no printing takes place, and a print position, at which printing occurs. The mounting of print heads to permit such movement is conventional in the art, and therefore no description of the details of the mounting will be specifically described herein.

Each guide 30*a–b* is preferably a smooth, elongated stationary post, with the guides being located so as to guide the print-ribbon 24 to and from the print head 22. Additionally, the feed roll 26 is rotatably mounted on a fixed shaft 32, with the feed roll being undriven. The feed roll 26 includes an uninterrupted length of the print-ribbon 24 thereon. The mounting of the feed roll 26 on the shaft 32 is such that rotation of the feed roll is slightly resisted to prevent unwinding of the print-ribbon 24 until a sufficient pulling force is applied to the print-ribbon.

The take-up roll 28 is rotatably mounted on a shaft 34 that is disposed on one end of an L-shaped support arm 36, with the other end of the support arm including a handle 38 connected thereto. The support arm 36 is pivotally mounted at the central portion thereof to a support base 40, to permit pivoting movements of the support arm. A cylindrical capstan 42 is rotatably mounted adjacent the take-up roll 28, with the capstan 42 being rotatably driven through a suitable connection to a drive means, such as a separate drive motor or the drive motor for the cylinder 12. The take-up roll 28 is biased into contact with the capstan 42 by a spring 44 that is connected between the support base 40 and the support arm 36 to continuously bias the take-up roll toward the capstan.

Since the take-up roll 28 is biased into contact with the capstan 42, rotation of the capstan causes rotation of the take-up roll, thereby taking-up, or winding, the print-ribbon 24 onto the take-up roll 28. Thus, when the capstan 42 is rotated, the take-up roll 28 rotates, thereby pulling the print-ribbon 24 from the feed roll 26, past the print head 22, and to the take-up roll 28. As the print-ribbon 24 is being taken up on the take-up roll 28, the diameter of the take-up roll increases, thus causing the roll to pivot about the axis of the support arm 36, away from the capstan 42. When the take-up roll 28 is full (i.e. when the feed roll 26 is empty), the take-up roll and feed roll need to be replaced. Replacement of the take-up roll 28 is accomplished by grasping and pulling the handle 38 to pivot the support arm 36 so that the take-up roll moves sufficiently away from the capstan 42 to permit the take-up roll to be removed and replaced with a new, empty take-up roll. The empty feed roll 26 is also removed from the shaft 32 and replaced with a full feed roll. Obviously, the feed roll and take-up roll can be constructed so as to be interchangeable, whereby a full take-up roll can be replaced by the empty feed roll, and vice-versa, thereby making replacement easier.

The apparatus 10 functions by printing spaced images on the receptor web 18. The first print station 14*a* begins the printing of one of the images onto the web. During this time the cylinder 12 is rotated, thereby moving the web 18 relative to the printhead 22 so that the first print station 14*a* can print the first color at the desired location(s) over the entire extent of the intended image. Once the first print station is finished printing, the first image is brought into registration with the second print station 14*b*. Simultaneously, the first print station is ready to start printing a second image onto the web, with the second image being spaced from the first image. The second print station performs printing on the first image in the second color, and then the first image is then brought into registration with the third print station. This process is repeated until the first image is brought into registration with each remaining print station so that the desired color image is completely printed onto the web. The use of multiple print stations 14*a–e* disposed around the cylinder allows a plurality of images to be printed at the same time, thereby increasing the throughput of the printer.

Once printing of the first image is completed, the first image is then mated with a card in the mating and image transfer station 20, to permit transfer of the topping layer and the ink receptor layer of the web onto the plastic card, thereby transferring the image onto the card. It should be apparent to a person having ordinary skill in the art that the length of each printed image on the web should be chosen so that the image is able to fit completely onto the card.

Figure 3:
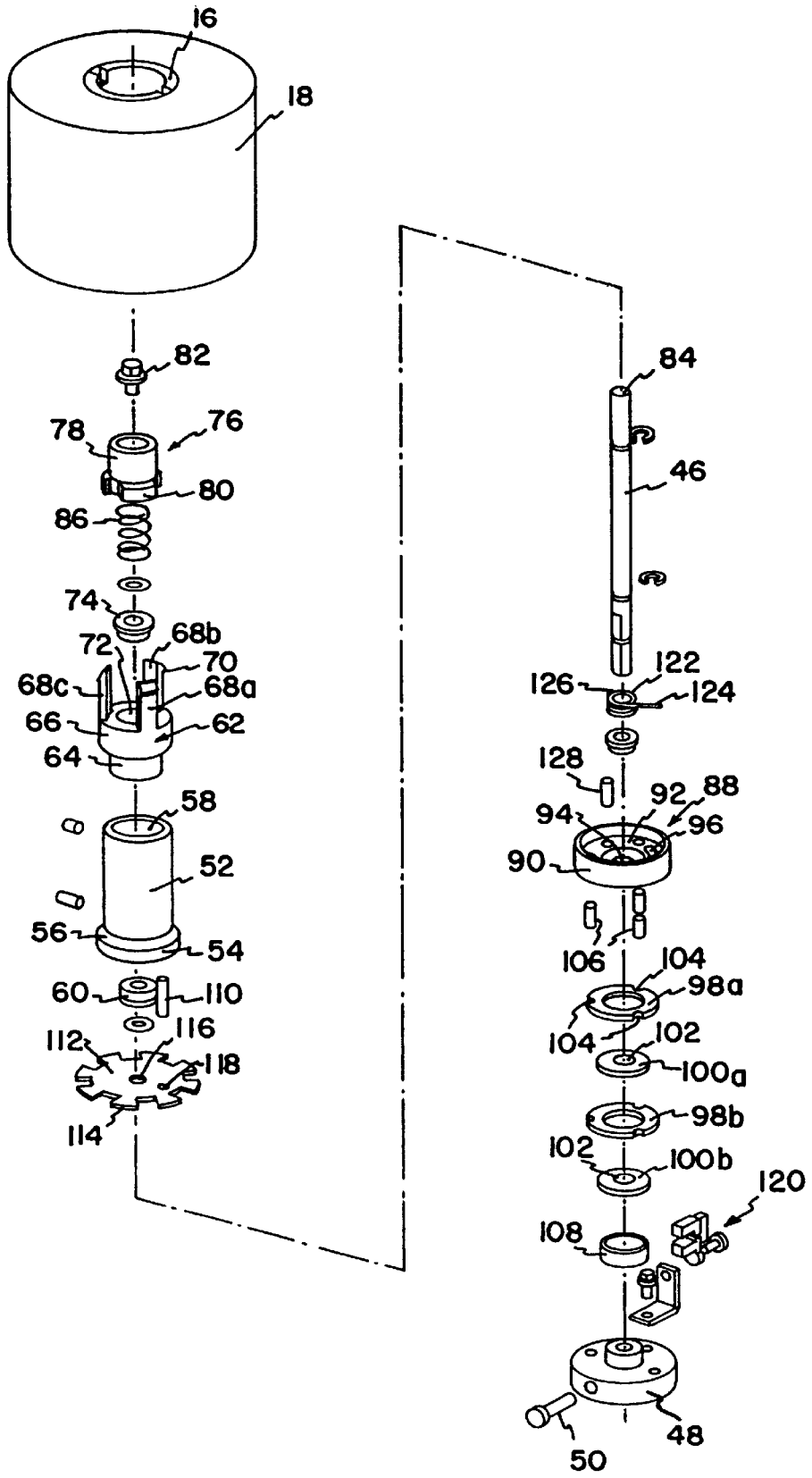
FIG. 3 is an exploded view showing the receptor web supply roll.

Turning to FIG. 3, an exploded view of the receptor web supply roll 16 is shown, illustrating how the supply roll 16 is rotatably mounted. A shaft 46 is fixed at one end thereof within a base block 48 using a fastener 50 or the like, with the shaft 46 extending vertically therefrom. A first, generally cylindrical bottom spindle 52 is disposed over the shaft 46 and includes an enlarged bottom portion 54 defining a tapered shoulder 56. A central passage 58 extends longitudinally through the spindle 52 having a diameter greater than the diameter of the shaft 46 to allow passage of the shaft. A bearing 60 fits within the bottom of the passage 58 for rotatably mounting the spindle 52 onto the shaft 46.

A top spindle 62 includes a small diameter section 64 that closely fits within the central passage 58 of the spindle 52 to allow the top spindle 62 to be fitted onto the bottom spindle 52. A large diameter section 66 of the spindle 62 includes three spaced fingers 68*a*,68*b*,68*c* extending axially therefrom. The fingers 68*a–c* are flexible and each finger includes a tapered shoulder 70 on the outside surface thereof. The spindle 62 also includes a central passage 72 extending therethrough having a diameter greater than the diameter of the shaft 46, and a bearing 74, similar to the bearing 60, is disposed within the passage 72 so as to rotatably mount the spindle 62 to the shaft 46.

In use, the two spindles 52,62 are fit together and disposed around the shaft 46 so as to rotate relative thereto. The receptor web supply roll 16, with the receptor web 18 thereon, is then disposed around the spindles 52,62, between the tapered shoulder 56 of the enlarged bottom portion 54 and the tapered shoulders 70 of the fingers 68*a–c*.

In order to fix the supply roll 16 in place, a cam mechanism 76 is disposed around the top end of the shaft 46 within the diameter defined by the fingers 68*a–c* so as to selectively bias the fingers outward and into contact with the roll 16. The cam mechanism 76 includes a cylindrical body portion 78 with the base end thereof having a plurality of spaced cam surfaces 80 defined thereon. The number of cam surfaces 80 corresponds with the number of fingers 68*a–c*, with the spacing between the cam surfaces corresponding with the spacing between the fingers. The cam surfaces 80 are designed so as to contact the fingers and bias them outward into engagement with the roll 16 based upon the rotational position of the body portion 78. In order to bias the fingers outward into contact with the roll, the cam mechanism 76 is rotated so that the cam surfaces 80 engage the fingers 68*a–c*, thus biasing them outwardly, such that the tapered shoulders 70 on the fingers engage the roll 16, whereby the roll is sandwiched between the shoulders 70 and the shoulder 56. Rotation of the cam mechanism in the opposite direction releases the outward bias on the fingers, to thereby permit the roll 16 to be replaced by slipping the roll off of the spindles 52,62. A threaded bolt 82 engages with a suitably provided threaded hole 84 in the end of the shaft 46 to secure the cam mechanism 76 in place. Further, a coil spring 86 is disposed between the bearing 74 and the bottom of the cam mechanism 76 to bias the cam mechanism outward, so as to facilitate gripping by a users fingers or with a suitable tool when rotation of the cam mechanism is desired. A similar arrangement can be used in order to mount the feed roll 26 and the take-up roll 28 on their respective shafts.

The supply roll 16 is preferably provided with a tensioning mechanism for applying a tension to the web 18 as it is being unwound from the roll 16 by the cylinder 12. The tensioning mechanism includes a cup-shaped friction disk 88 disposed around the shaft 46 below the spindle 52. The friction disk 88 is cup-shaped and includes a cylindrical side wall 90 and a bottom wall 92. The bottom wall 92 has a centrally located hole 94 therein permitting free passage of the shaft 46, and an arcuate slot 96 formed between the hole 94 and the side wall 90, the purpose of which will become apparent later in the description. First and second notched disks 98*a*,98*b* are disposed below the friction disk 88 and alternate with first and second washers 100*a*,100*b*. The washers 100*a,b* include central apertures 102 that are shaped such that the washers are fixed to the shaft 46 to prevent rotation of the washers on the shaft, but are axially slideable thereon. The notched disks 98*a,b* each include three spaced notches 104 in the outer circumference thereof, with pins 106 connected to and extending from the bottom wall 92 of the friction disk 88 engaging in the notches so that the notched disks are fixed to and rotate with the friction disk 88. A cylindrical compression spring 108, such as a helical coil spring, is disposed around the end of the shaft 46, and rests upon the base block 48 and engages the bottom of the second washer 100*b*. The spring 108 biases the washers 100*a,b* and notched disks 98*a,b* upward into engagement with each other and the bottom of the friction disk 88, such that when the friction disk 88 rotates, which causes the notched disks to rotate, friction is created between the notched disks and the stationary washers, thus resisting rotation of the roll 16 and thereby applying a tension to the web 18.

In order to cause the friction disk 88 to rotate, the enlarged bottom portion 54 includes a pin 110 connected thereto and extending downward toward the disk 88 and through arcuate slot 96. Since the pin 110 is fixed to the spindle 52, it rotates therewith. The pin 110 and slot 96 arrangement permits limited rotational movements of the spindle 52 relative to the disk 88 within the range defined by the slot 96. However, once the pin 110 contacts the end of the slot 96, the disk 88 then rotates with the spindle 52, which causes the notched disks 98*a,b* to rotate relative to the washers 100*a,b*, thereby creating the frictional tension force on the web 18.

In order to sense the amount of rotational movement of the roll 16, a notched disk 112 with a plurality of circumferentially spaced radial fingers 114 is disposed around the shaft 46 under the spindle 52. The disk 112 includes a central aperture 116 permitting passage of the shaft, and an offset aperture 118 through which the pin 110 extends so that the disk 112 rotates with the spindle 52. A sensor assembly 120 is secured to the top of the base block 48 and is disposed relative to the disk 112 for sensing the passage of the fingers 114 as the disk 112 rotates with the roll 16, thereby providing an indication of the amount of rotation of the roll 16.

A torsion spring 122 is disposed about the shaft 46 between the disk 112 and the friction disk 88. The spring 122 is preferably a coiled spring of conventional construction and includes a first finger 124 that engages the pin 110, and a second finger 126 that engages a pin 128 that is connected to and extends from the bottom wall 92 of the friction disk 88. The torsion spring 122 maintains tension on the web 18 once feeding of the web 18 to the cylinder is stopped, i.e. once rotation of the cylinder 12 stops.

Figure 4:
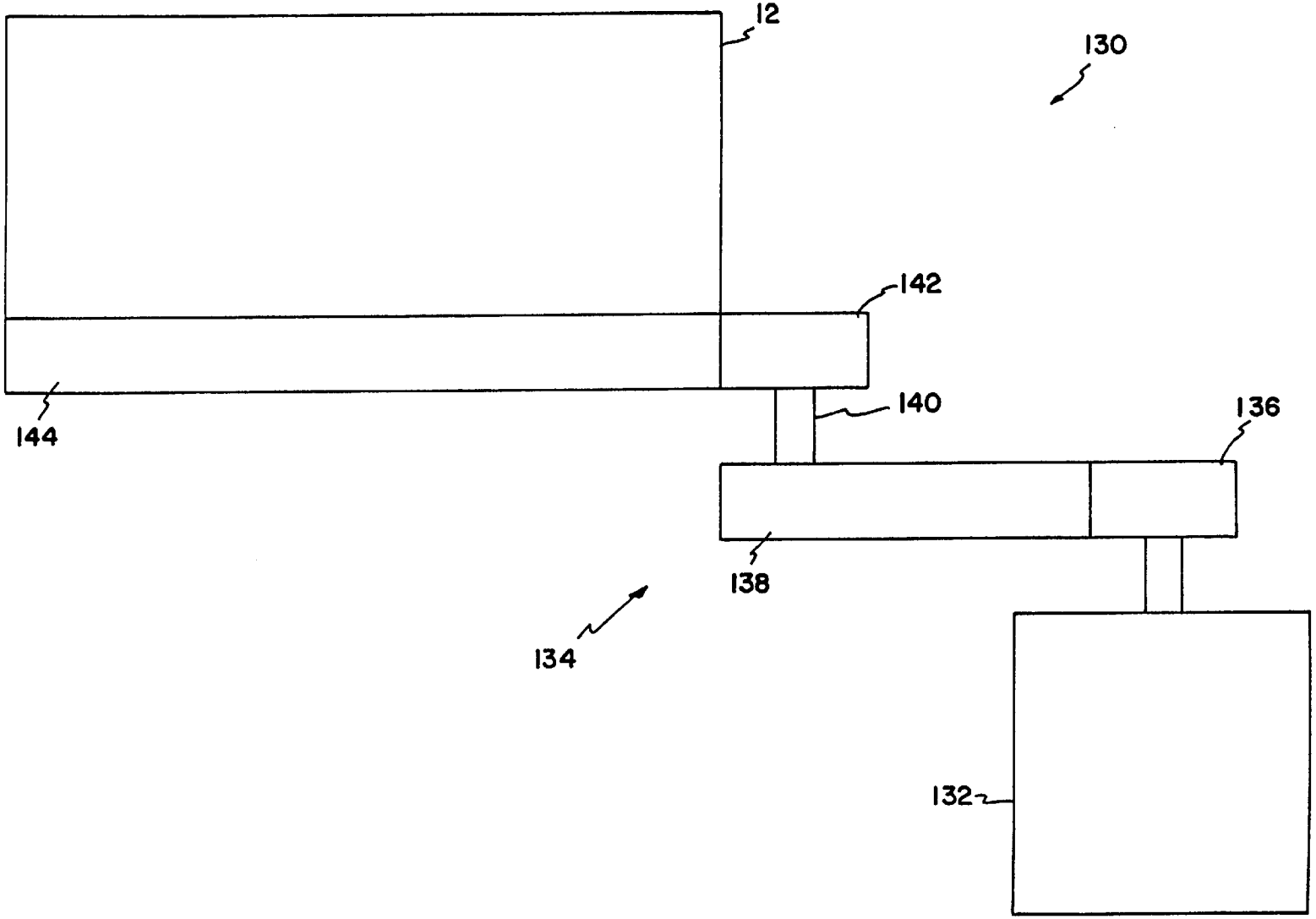
FIG. 4 illustrates the drive mechanism for driving the cylinder.

The drive mechanism 130 for driving the cylinder 12 is illustrated in FIG. 4. The drive mechanism 130 forms an open loop positional control for the cylinder 12. As shown, the cylinder 12 is driven by a motor 132, preferably a stepper motor, through a gearing assembly 134 to achieve precise positioning of the cylinder and the receptor web 18 frictionally engaged therewith relative to the print stations 14*a–e*. Although the drive mechanism is described as being a stepper motor and gearing assembly, other incremental digital drive mechanisms can be used if desired.

The gearing assembly 134 includes a first pinion gear 136 that is driven by the motor 132, and an intermediate gear 138 engaged with and driven by the first pinion gear 136. A shaft 140 extends from the intermediate gear 138, and a second pinion gear 142 is fixed on the end of the shaft 140 so as to rotate with the gear 138. A large diameter gear 144 is connected to the cylinder 12 and is driven by the second pinion gear l42.

As shown in FIG. 4, the diameter of the gear 144 is made to be large relative to the sizes of the other gears 136,138, 142. For instance, the diameter of the gear 144 can be approximately equal to the diameter of the cylinder 12, however the diameter of the gear 144 can be either larger or smaller than the diameter of the cylinder. The large diameter of the gear 144 minimizes the effects of eccentricities and other errors in the gear 144, so that the errors have minimal or no effect on the positioning of the web 18 relative to the print stations 14*a–e*.

The diameter of the second pinion gear 142 is selected so that the pinion gear 142 rotates exactly twice during the printing operation on each segment, thereby canceling out any eccentricity errors in the gears 138, 142, so that such errors do not effect the alignment of the web with the print stations. Further, the effects due to errors in the gears 136,138 are reduced by the reduction ratio of the gear 142 to the gear 144. Therefore the gearing assembly 134 is specifically designed so that the effects of errors in the gears 136,138,142,144 on the positioning of the cylinder 12 and web 18 are minimized. Further, the drum 12 is preferably sized so that it is an integer value of the motor resolution. A drag brake or the like can also be provided on the gear assembly 134 in order to reduce backlash and load variations.

It is to be understood that while certain embodiments of the present invention have been illustrated and described, the invention is not limited to the specific forms or arrangements of the parts described and shown.

We claim:

1. A method of color printing on a card, comprising:

a) providing a rotatable cylinder having an outer surface and a plurality of color print stations spaced circumferentially about the cylinder;

b) supplying an uninterrupted length of a receptor web to the outer surface of the cylinder and in frictional engagement therewith;

c) rotating the cylinder to thereby position the receptor web relative to one of the color print stations, and printing onto the receptor web using the one color print station to form a printed portion, wherein rotating the cylinder comprises using a pinion gear that rotates twice during the printing operation on each segment; and d) mating the printed portion of the receptor web with the card.

2. The method of color printing according to claim 1, wherein the step of supplying the receptor web comprises applying tension to the receptor web.

3. The method of color printing according to claim 1, wherein the step of rotating the cylinder comprises connecting a stepper motor to the cylinder, and actuating the stepper motor to rotate the cylinder.

4. The method of color printing according to claim 1, including repeating step c) for at least one of the other color print stations.

5. The method of color printing according to claim 1, including repeating step c) for each of the remaining color print stations.

6. A multi-color printing apparatus, comprising:

a rotatable cylinder having an outer surface;

a plurality of color print stations spaced circumferentially about the cylinder;

an uninterrupted length of a receptor web frictionally engaged with the outer surface of the cylinder such that the web is rotatable therewith; and a drive mechanism connected to the cylinder for rotating the cylinder and the receptor web disposed on the outer surface thereof to thereby position the receptor web relative to the color print stations; wherein said drive mechanism comprises a drive motor and a gearing assembly connected between the drive motor and the cylinder; wherein said gearing assembly includes a first gear connected to the cylinder, and a second, pinion gear engaged with the first gear and in driving engagement with the drive motor, the diameter of said first gear being greater than the diameter of the second pinion gear; and further including a mating and image transfer station for receiving the receptor web.

7. The multi-color printing apparatus according to claim 6, wherein said drive motor comprises a stepper motor.

8. The multi-color printing apparatus according to claim 6, wherein the printing apparatus prints onto segments of the receptor web; and said second, pinion gear is configured such that the second gear revolves twice as one of the segments of the receptor web moves from a first one of said plurality of color print stations to a last one of said color print stations.

9. A multi-color printing apparatus, comprising:

a rotatable cylinder having an outer surface;

a plurality of color print stations spaced circumferentially about the cylinder; wherein each said print stations include a printhead, a color print-ribbon, a print-ribbon feed roll, a print-ribbon take-up roll and print ribbon guides; further including a capstan mounted adjacent each said take-up roll, and biasing means for biasing said take-up roll against said capstan;

an uninterrupted length of a receptor web frictionally engaged with the outer surface of the cylinder such that the web is rotatable therewith; and a drive mechanism connected to the cylinder for rotating the cylinder and the receptor web disposed on the outer surface thereof to thereby position the receptor web relative to the color print stations; and further including a mating and image transfer station for receiving the receptor web.

10. The multi-color printing apparatus according to claim 9, wherein each said take-up roll is rotatably mounted, and each said capstan is rotatably driven and causes rotation of the respective take-up roll.

11. The multi-color printing apparatus according to claim 9, further including support arms supporting each said take-up roll, said support arms being pivotally mounted within the printing apparatus; and further comprising a handle connected to each said support arm.

12. The multi-color printing apparatus according to claim 11, wherein each said support arm includes first and second portions extending perpendicular relative to each other.

* * * * *